US010704333B2

(12) United States Patent
Pan et al.

(10) Patent No.: US 10,704,333 B2
(45) Date of Patent: Jul. 7, 2020

(54) METAL MATRIX COMPOSITE DRILL BITS WITH REINFORCING METAL BLANKS

(71) Applicant: Halliburton Energy Services, Inc., Houston, TX (US)

(72) Inventors: Yi Pan, The Woodlands, TX (US); Garrett T. Olsen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 264 days.

(21) Appl. No.: 15/753,919

(22) PCT Filed: Sep. 22, 2015

(86) PCT No.: PCT/US2015/051343
§ 371 (c)(1),
(2) Date: Feb. 20, 2018

(87) PCT Pub. No.: WO2017/052504
PCT Pub. Date: Mar. 30, 2017

(65) Prior Publication Data

US 2018/0252046 A1 Sep. 6, 2018

(51) Int. Cl.

| | |
|---|---|
| ***E21B 10/55*** | (2006.01) |
| ***E21B 10/54*** | (2006.01) |
| ***C22C 32/00*** | (2006.01) |
| ***B22F 7/06*** | (2006.01) |
| *C22C 26/00* | (2006.01) |
| *B22F 5/00* | (2006.01) |

(52) U.S. Cl.
CPC ..... *E21B 10/55* (2013.01); *B22F 7/062* (2013.01); *C22C 32/00* (2013.01); *E21B 10/54* (2013.01); *B22F 2005/001* (2013.01); *C22C 26/00* (2013.01); *C22C 32/0005* (2013.01); *C22C 32/0084* (2013.01)

(58) Field of Classification Search
CPC ..... E21B 10/55; E21B 10/54; C22C 32/00; C22C 26/00; C22C 32/0005; C22C 32/0084; B22F 7/062; B22F 2005/001
See application file for complete search history.

(56) References Cited

U.S. PATENT DOCUMENTS

| | | | |
|---|---|---|---|
| 5,033,559 | A | 7/1991 | Fischer |
| 5,765,095 | A | 6/1998 | Flak et al. |
| 6,148,936 | A | 11/2000 | Evans et al. |
| 6,655,481 | B2 | 12/2003 | Findley et al. |

(Continued)

OTHER PUBLICATIONS

ISR/WO for PCT/US2015/051343 dated Jun. 21, 2016.

*Primary Examiner* — Michael R Wills, III
(74) *Attorney, Agent, or Firm* — Thomas Rooney; C. Tumey Law Group PLLC

(57) ABSTRACT

A reinforcing metal blank may be used to form metal matrix composite (MMC) drill bits. For example, an MMC drill bit may include a shank attached to a reinforcing metal blank that extends into a bit body comprising a metal matrix composite, wherein the reinforcing metal blank comprises reinforcing structures that are positioned along at least a portion of an inner surface and/or at least a portion of an outer surface of the reinforcing metal blank and extend into the metal matrix composite; and a plurality of cutting elements coupled to an exterior portion of the bit body.

17 Claims, 7 Drawing Sheets

(56) References Cited

U.S. PATENT DOCUMENTS

| | | | | |
|---|---|---|---|---|
| 7,044,243 | B2 * | 5/2006 | Kembaiyan | E21B 10/55 175/425 |
| 7,395,884 | B2 | 7/2008 | Kembaiyan et al. | |
| 7,594,454 | B2 | 9/2009 | Zahradnik et al. | |
| 7,775,287 | B2 | 8/2010 | Duggan et al. | |
| 7,784,381 | B2 | 8/2010 | Ladi et al. | |
| 7,954,569 | B2 | 6/2011 | Mirchandani et al. | |
| 8,109,177 | B2 | 2/2012 | Kembaiyan | |
| 8,220,566 | B2 | 7/2012 | Eason et al. | |
| 8,381,844 | B2 | 2/2013 | Matthews, III et al. | |
| 8,387,677 | B2 | 3/2013 | Gallego | |
| 8,616,089 | B2 | 12/2013 | Choe et al. | |
| 8,893,828 | B2 | 11/2014 | Lockwood et al. | |
| 2002/0096306 | A1 | 7/2002 | Butcher et al. | |
| 2004/0149494 | A1 | 8/2004 | Kembaiyan et al. | |
| 2007/0102202 | A1 * | 5/2007 | Choe | E21B 10/567 175/425 |
| 2009/0032310 | A1 | 2/2009 | Stevens et al. | |
| 2013/0180786 | A1 | 7/2013 | Thomas et al. | |
| 2013/0270008 | A1 * | 10/2013 | DiGiovanni | E21B 47/00 175/40 |
| 2014/0087202 | A1 | 3/2014 | Wang et al. | |
| 2014/0131115 | A1 | 5/2014 | Thigpen et al. | |
| 2016/0053349 | A1 * | 2/2016 | Nielsen, Jr. | C22C 9/06 420/473 |
| 2016/0151831 | A1 * | 6/2016 | Olsen | B22C 9/08 264/112 |

* cited by examiner

METAL MATRIX COMPOSITE DRILL BITS WITH REINFORCING METAL BLANKS

The present application is a U.S. National Phase entry under 35 U.S.C. § 371 of International Application No. PCT/US2015/051343, filed on Sep. 22, 2015, the entirety of which is incorporated herein by reference.

BACKGROUND

A wide variety of tools are used in the oil and gas industry for forming wellbores, in completing drilled wellbores, and in producing hydrocarbons such as oil and gas from completed wells. Examples of these tools include cutting tools, such as drill bits, reamers, stabilizers, and coring bits; drilling tools, such as rotary steerable devices and mud motors; and other tools, such as window mills, tool joints, and other wear-prone tools. These tools, and several other types of tools outside the realm of the oil and gas industry, are often formed as metal matrix composites (MMCs).

Cutting tools, in particular, are frequently used to drill oil and gas wells, geothermal wells, and water wells. For example, fixed cutter MMC drill bits may be formed with a composite bit body (sometimes referred to in the industry as a matrix bit body), having cutting elements or inserts disposed at select locations about the exterior of the matrix bit body. During drilling, these cutting elements engage the subterranean formation and remove adjacent portions thereof.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to tool manufacturing and, more particularly, to using a reinforcing metal blank during the formation of metal matrix composite (MMC) drill bits.

As is discussed further herein, metal blanks used in the manufacture of MMCs are typically machined out of a common grade of steel. The metal blank is bonded to a MMC in situ during an infiltration process that produces the MMC. After further processing, the metal blank bonded to the MMC forms part of a MMC fixed-cutter drill bit (also referred to herein as an "MMC drill bit"). The interface between the MMC and the metal blank may experience significant torque during drilling operations, and any defects in the interface may cause the bond between MMC and metal blank to fail, which reduces the lifetime of the MMC drill bit. This failure mode is exacerbated when the MMC and the metal blank have different coefficients of thermal expansion (CTE). In such cases, when the drill bit is heated rapidly, for example, during drilling, the interface experiences additional strain because of the CTE mismatch.

The embodiments of the present disclosure use a reinforcing metal blank that mechanically strengthens to the bond between the MMC and the metal blank.

Figure 1:
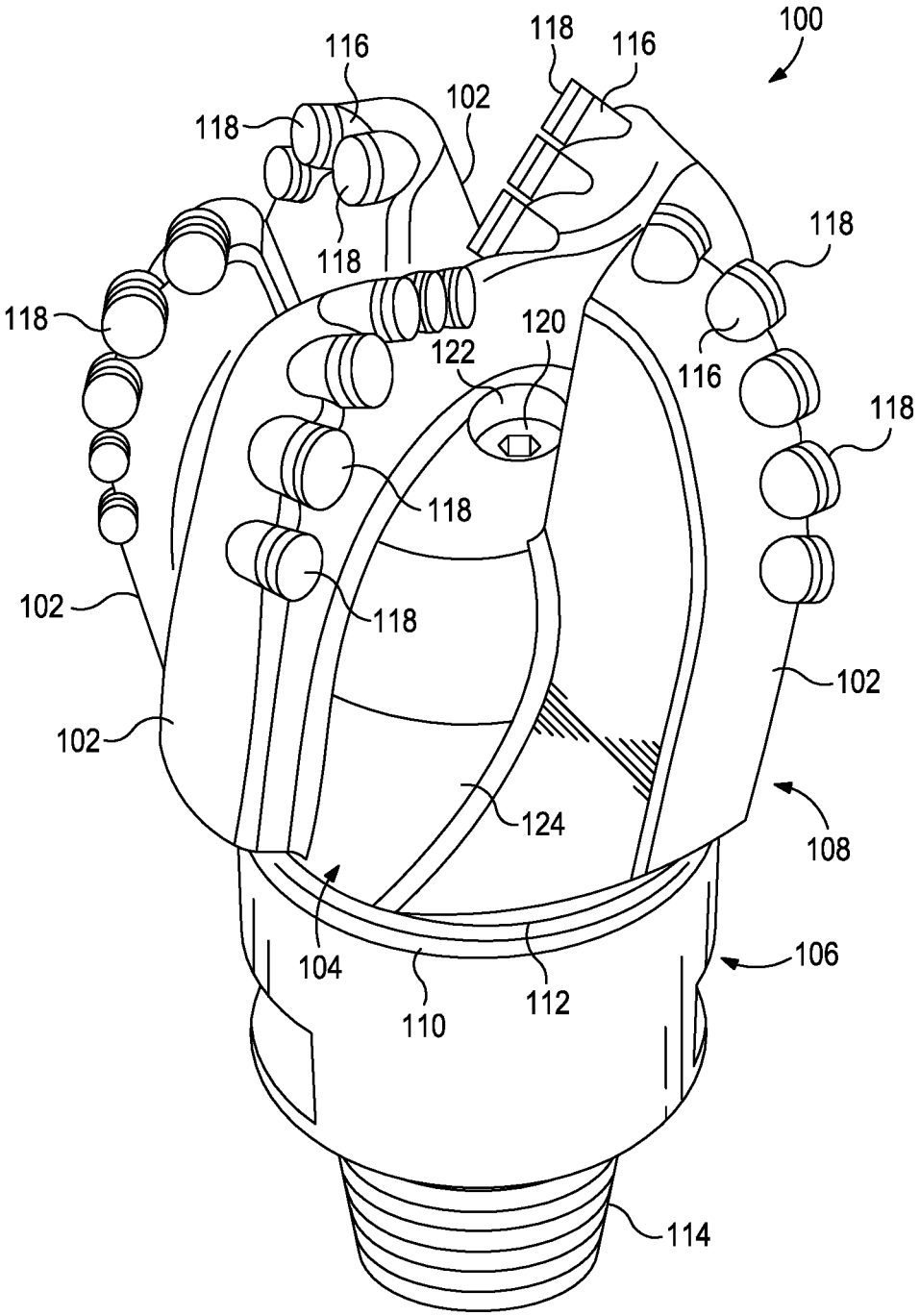
FIG. 1 is a perspective view of an exemplary metal matrix composite (MMC) drill bit that can incorporate the principles of the present disclosure.

FIG. 1 is a perspective view of an example MMC drill bit 100 that may be fabricated in accordance with the principles of the present disclosure. The MMC drill bit 100 may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding, which results in the formation of a weld 110 formed within a weld groove 112. The shank 106 may further include or otherwise be connected to a threaded pin 114, such as an American Petroleum Institute (API) drill pipe thread.

In the depicted example, the MMC drill bit 100 includes five cutter blades 102, in which multiple recesses or pockets 116 are formed. A cutting element 118 may be fixedly installed within each recess 116. This can be done, for example, by brazing each cutting element 118 into a corresponding recess 116. As the MMC drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the MMC drill bit 100 at the threaded pin 114. The drilling fluid circulates through and out of the MMC drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2:
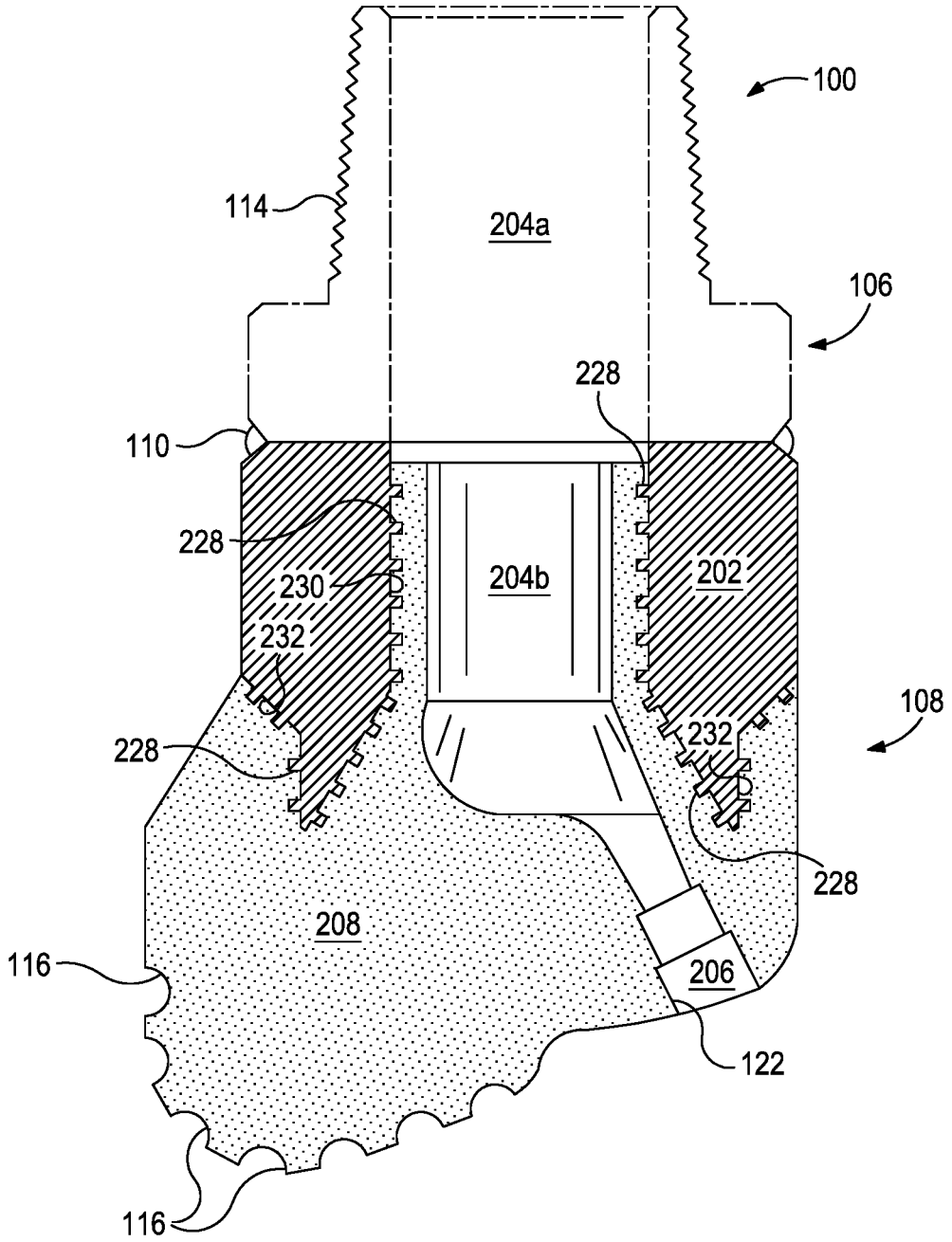
FIG. 2 is a cross-sectional view of the MMC drill bit of FIG. 1.

FIG. 2 is a cross-sectional side view of the MMC drill bit 100 of FIG. 1. Similar numerals from FIG. 1 that are used in FIG. 2 refer to similar components that are not described again. The shank 106 may be securely attached to a reinforcing metal blank (or reinforcing mandrel) 202 at the weld 110 and the reinforcing metal blank 202 extends into the bit body 108. The shank 106 and the reinforcing metal blank 202 are generally cylindrical structures that define corresponding fluid cavities 204*a* and 204*b*, respectively, in fluid communication with each other. The fluid cavity 204*b* of the reinforcing metal blank 202 may extend longitudinally into the bit body 108. At least one flow passageway 206 (one shown) may extend from the fluid cavity 204*b* to exterior portions of the bit body 108. The nozzle openings 122 (one shown in FIG. 2) may be defined at the ends of the flow passageways 206 at the exterior portions of the bit body 108.

The pockets 116 are formed in the bit body 108 and are shaped or otherwise configured to receive the cutting elements 118 (FIG. 1).

The bit body 108 may comprise an MMC 208. The reinforcing metal blank 202 includes reinforcing structures 228 that extend into the MMC 208. In some embodiments, the reinforcing structures 228 may be machined portions of the reinforcing metal blank 202. In other embodiments, however, the reinforcing structures 228 may comprise molded portions of the reinforcing metal blank 202. In yet other embodiments, the reinforcing structures 228 may be coupled to the outer periphery of the reinforcing metal blank 202 at select locations.

The reinforcing structures 228 may be positioned along at least a portion of an inner surface 230 and/or at least a portion of an outer surface 232 of the reinforcing metal blank 202. In the illustrated embodiment, the reinforcing structures 228 are positioned along the inner and outer surfaces 230,232 of the reinforcing metal blank 202. In alternative embodiments, the reinforcing metal blank 202 may include reinforcing structures 228 along all or a portion of its outer surface 232 and not along its inner surface 230. In other embodiments, the reinforcing metal blank 202 may include reinforcing structures 228 along all or a portion of its inner surface 230 and not along its outer surface 232. In yet other embodiments, the reinforcing metal blank 202 may include reinforcing structures 228 along portions of its inner and outer surfaces 230,232.

Figure 3:
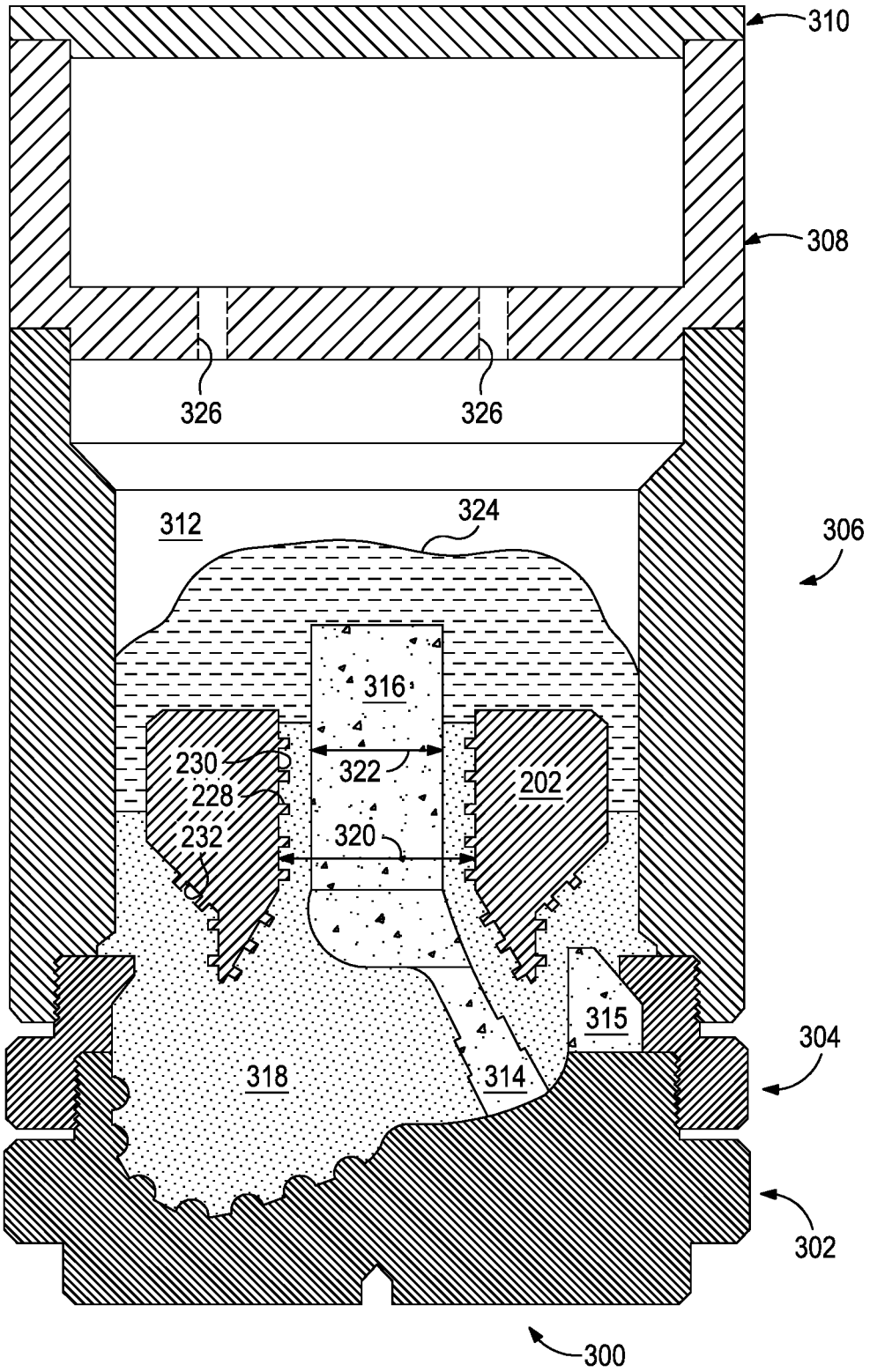
FIG. 3 is a cross-sectional side view of an exemplary mold assembly for use in forming the MMC drill bit of FIG. 1.
Figure 4:
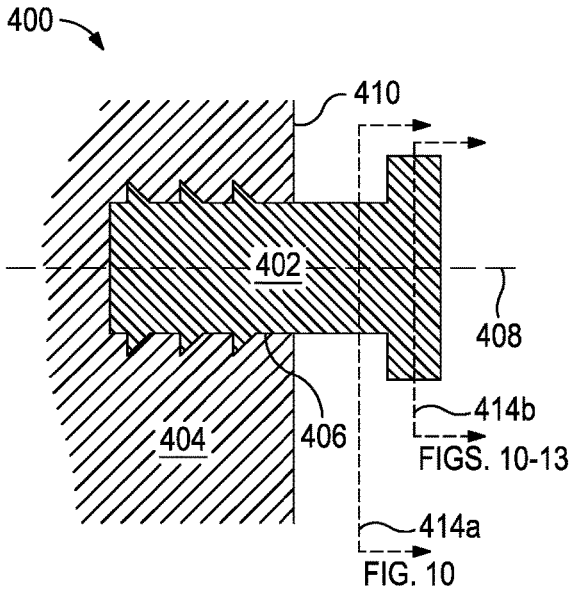
FIGS. 4-9 illustrate various configurations of reinforcing structures coupled to metal blanks to form reinforcing metal blanks.
Figure 5:
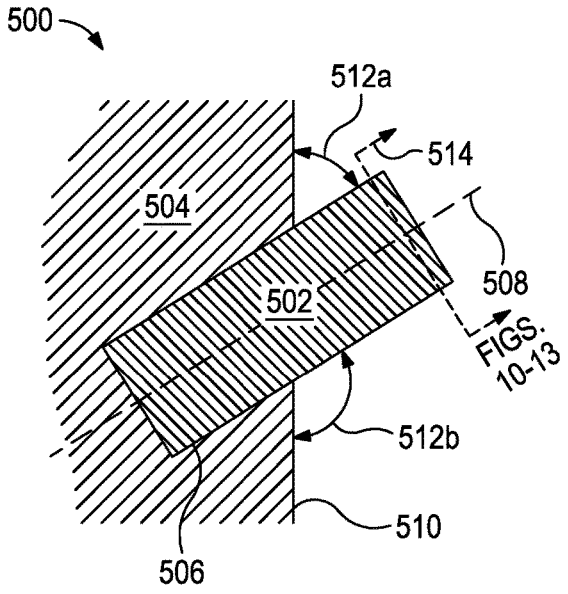
Figure 6:
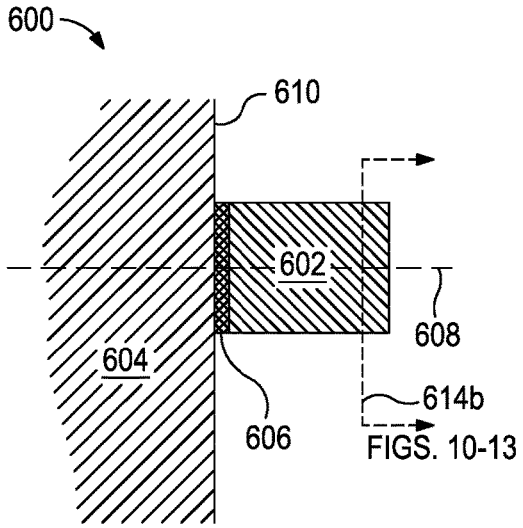
Figure 7:
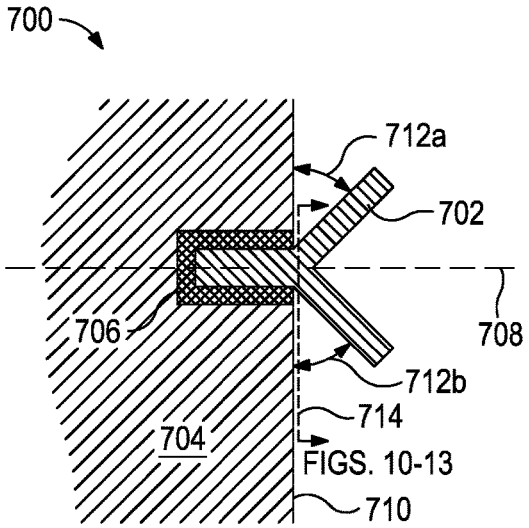
Figure 8:
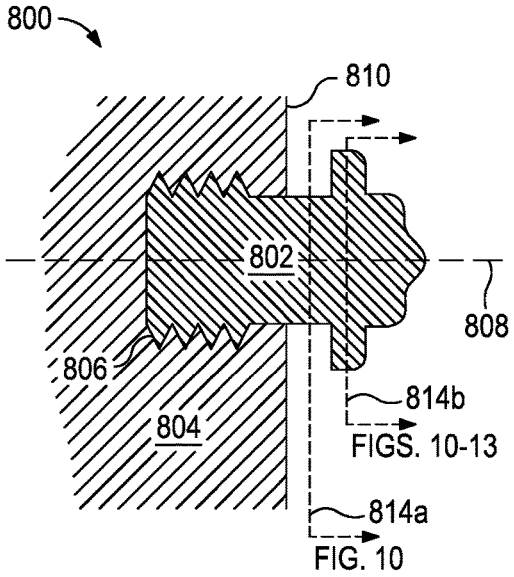
Figure 9:
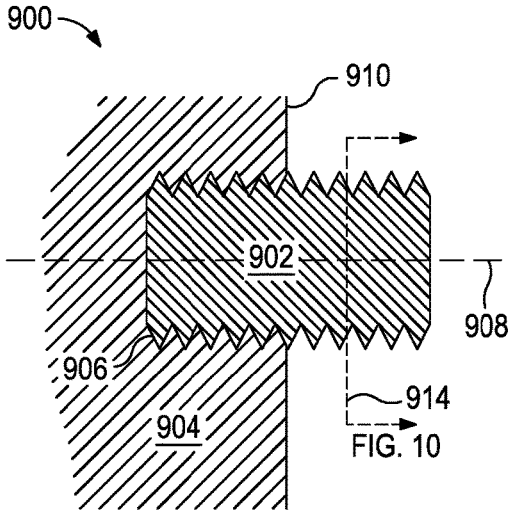
Figure 10:
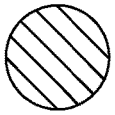
FIGS. 10-13 illustrate four of the exemplary radial cross-sectional shapes suitable for the reinforcing structures described herein
Figure 11:
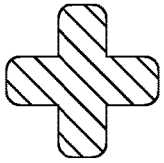

FIG. 3 is a cross-sectional side view of a mold assembly 300 that may be used to form the MMC drill bit 100 of FIGS. 1 and 2. While the mold assembly 300 is shown and discussed as being used to help fabricate the MMC drill bit 100, those skilled in the art will readily appreciate that varying configurations of the mold assembly 300 may be used in fabricating any of the MMC drill bits and parts mentioned herein, without departing from the scope of the disclosure. As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In other embodiments, the gauge ring 304 may be omitted from the mold assembly 300 and the funnel 306 may instead be operatively coupled directly to the mold 302, such as via a corresponding threaded engagement, without departing from the scope of the disclosure.

In some embodiments, as illustrated, the mold assembly 300 may further include a binder bowl 308 and a cap 310 placed above the funnel 306. The mold 302, the gauge ring 304, the funnel 306, the binder bowl 308, and the cap 310 may each be made of or otherwise comprise graphite or alumina ($Al_2O_3$), for example, or other suitable materials. An infiltration chamber 312 may be defined or otherwise provided within the mold assembly 300. Various techniques may be used to manufacture the mold assembly 300 and its components, such as machining graphite blanks to produce the various components and thereby define the infiltration chamber 312 to exhibit a negative or reverse profile of desired exterior features of the MMC drill bit 100 (FIGS. 1 and 2).

Materials, such as consolidated sand or graphite, may be positioned within the mold assembly 300 at desired locations to form various features of the MMC drill bit 100 (FIGS. 1 and 2). For example, one or more nozzle displacements or legs 314 (one shown) may be positioned to correspond with desired locations and configurations of the flow passageways 206 (FIG. 2) and their respective nozzle openings 122 (FIGS. 1 and 2). One or more junk slot displacements 315 may also be positioned within the mold assembly 300 to correspond with the junk slots 124 (FIG. 1). Moreover, a cylindrically-shaped central displacement 316 may be placed on the legs 314. The number of legs 314 extending from the central displacement 316 will depend upon the desired number of flow passageways and corresponding nozzle openings 122 in the MMC drill bit 100. Further, cutter-pocket displacements (shown as part of mold 302 in FIG. 3) may be placed in the mold 302 to form cutter pockets 116.

After the desired materials, including the central displacement 316 and the legs 314, have been installed within the mold assembly 300, reinforcement materials 318 may then be placed within or otherwise introduced into the mold assembly 300.

Reinforcing particles suitable for use in conjunction with the embodiments described herein may include particles of metals, metal alloys, metal carbides, metal nitrides, diamonds, superalloys, and the like, or any combination thereof. Examples of reinforcing particles suitable for use in conjunction with the embodiments described herein may include particles that include, but not be limited to, nitrides, silicon nitrides, boron nitrides, cubic boron nitrides, natural diamonds, synthetic diamonds, cemented carbide, spherical carbides, low alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, chromium alloys, HASTELLOY® alloys (nickel-chromium containing alloys, available from Haynes International), INCONEL® alloys (austenitic nickel-chromium containing superalloys, available from Special Metals Corporation), WASPALOYS® (austenitic nickel-based superalloys), RENE® alloys (nickel-chrome containing alloys, available from Altemp Alloys, Inc.), HAYNES® alloys (nickel-chromium containing superalloys, available from Haynes International), INCOLOY® alloys (iron-nickel containing superalloys, available from Mega Mex), MP98T (a nickel-copper-chromium superalloy, available from SPS Technologies), TMS alloys, CMSX® alloys (nickel-based superalloys, available from C-M Group), N-155 alloys, any mixture thereof, and any combination thereof. In some embodiments, the reinforcing particles may be coated. By way of nonlimiting example, the reinforcing particles may include diamond coated with titanium.

The reinforcing particles described herein may exhibit a size and general diameter range from 1 micron to 1000 microns (e.g., 1 micron to 100 microns, 1 micron to 500 microns, 10 microns to 100 microns, 50 microns to 500 microns, 100 microns to 1000 microns, 250 microns to 1000 microns, or 500 microns to 1000 microns).

The reinforcing metal blank 202 may be supported at least partially by the reinforcement materials 318 within the infiltration chamber 312. More particularly, after a sufficient volume of the reinforcement materials 318 has been added to the mold assembly 300, the reinforcing metal blank 202 may then be placed within mold assembly 300. The reinforcing metal blank 202 may include an inside diameter 320 that is greater than an outside diameter 322 of the central displacement 316, and various fixtures (not expressly shown) may be used to position the reinforcing metal blank 202 within the mold assembly 300 at a desired location. The reinforcement materials 318 may then be filled to a desired level within the infiltration chamber 312. In some instances, depending on the shape of spacing between the reinforcing structures 228, the reinforcement materials 318 may be more carefully placed or packed around the reinforcing structures 228 to mitigate voids with minimal to no reinforcement materials 318.

Binder material 324 may then be placed on top of the reinforcement materials 318, the reinforcing metal blank 202, and the core 316. Suitable binder materials 324 include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Non-limiting examples of the binder material 324 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially-available binder materials 324 include, but are not limited to, VIRGIN™ Binder 453D (copper-manganese-nickel-zinc, available from Belmont Metals, Inc.), and copper-tin-manganese-nickel and copper-tin-manganese-nickel-iron grades 516, 519, 523, 512, 518, and 520 available from ATI Firth Sterling.

In some embodiments, the binder material 324 may be covered with a flux layer (not expressly shown). The amount of binder material 324 (and optional flux material) added to the infiltration chamber 312 should be at least enough to infiltrate the reinforcement materials 318 during the infiltration process. In some instances, some or all of the binder material 324 may be placed in the binder bowl 308, which may be used to distribute the binder material 324 into the infiltration chamber 312 via various conduits 326 that extend therethrough. The cap 310 (if used) may then be placed over the mold assembly 300. The mold assembly 300 and the materials disposed therein may then be preheated and then placed in a furnace (not shown). When the furnace temperature reaches the melting point of the binder material 324, the binder material 324 will liquefy and proceed to infiltrate the reinforcement materials 318.

After a predetermined amount of time allotted for the liquefied binder material 324 to infiltrate the reinforcement materials 318, the mold assembly 300 may then be removed from the furnace and cooled at a controlled rate. Once cooled, the mold assembly 300 may be broken away to expose the bit body 108 (FIGS. 1 and 2) that includes the MMC 208 (FIG. 2). Subsequent processing according to well-known techniques may be used to finish the MMC drill bit 100 (FIG. 1).

The foregoing example provides an exemplary configuration for the reinforcing structures 228. Other configurations are within the scope of the present disclosure. For example, in alternative embodiments, reinforcing structures may be distinct from and coupled to a metal blank to form the reinforcing metal blank.

FIGS. 4-9 illustrate various configurations of reinforcing structures 402,502,602,702,802,902 coupled to metal blanks 404,504,604,704,804,904 to form reinforcing metal blanks 400,500,600,700,800,900.

A reinforcing structure 402,502,602,702,802,902 may be coupled to a metal blank 404,504,604,704,804,904 at a joint 406,506,606,706,806,906, respectively. Examples of joints may include, but are not limited to, a braze joint 706, a weld joint 606, a threaded joint 406,806,906, an interference joint 506, and the like, and any combination thereof. Accordingly, methods of the present disclosure may involve coupling (e.g., via brazing, welding, threading, joining via an interference joint 506, and the like) one or more reinforcing structures 402,502,602,702,802,902 to at least a portion of an inner surface and/or at least a portion of an outer surface of a metal blank 404,504,604,704,804,904 to form a reinforcing metal blank 400,500,600,700,800,900; and forming (e.g., via an infiltration method described herein) a metal matrix composite drill bit comprising the reinforcing metal blank 400,500,600,700,800,900 and a metal matrix composite such that the reinforcing structures 402,502,602,702,802,902 extend into the metal matrix composite.

The cross-sectional shape of the portion of the reinforcing structure 402,502,602,702,802,902 extending from the metal blank 404,504,604,704,804,904 may provide additional mechanical strength enhancements to the bond between the reinforcing metal blank 400,500,600,700,800,900 and the MMC (e.g., MMC 208 of FIG. 2).

For the reinforcing structures described herein, a length or longitudinal axis 408,508,608,708,808,908 is defined (1) along the direction the reinforcing structure 402,502,702,802,902 extends into the metal blank 404,504,704,804,904 for a reinforcing structure 402,502,702,802,902 that extend into the metal blank 404,504,704,804,904 or (2) along the direction the reinforcing structure 602 extends from the metal blank 604 for reinforcing structures 602 that do not extend into the metal blank 604. Exemplary longitudinal cross-sectional shapes for the portion of the reinforcing structure 402,502,602,702,802,902 extending from the metal blank 404,504,604,704,804,904 may include, but are not limited to, T-shaped (FIG. 4), Y-shaped (FIG. 7), rectangular (FIGS. 5-6 and 9), mushroom-shaped (FIG. 8), and the like, and any hybrid thereof, wherein one or more the edges of the foregoing shapes may be uneven (e.g., wavy (FIG. 8) or spiked (FIG. 9)). Such non-straight edges may increase the surface area of the portion of the reinforcing structure 402,502,602,702,802,902 extending from the metal blank 404,504,604,704,804,904, which may provide further mechanical strength enhancements to the bond between the reinforcing metal blank 400,500,600,700,800,900 and the MMC (e.g., MMC 208 of FIG. 2).

For the reinforcing structures described herein, a radial cross-section 414*a*,414*b*,514,614,714,814*a*,814*b*,914 is defined along a plane perpendicular to the length or longitudinal axis 408,508,608,708,808,908.

Figure 12:
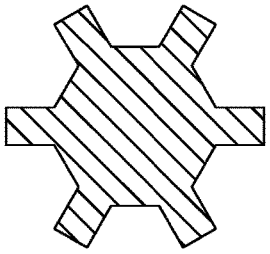
Figure 13:
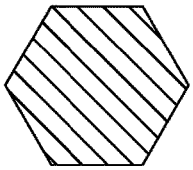

FIGS. 10-13 illustrate four of the exemplary radial cross-sectional shapes 414*a*,414*b*,514,614,714,814*a*,814*b*,914 suitable for the reinforcing structures 402,502,602,702,802,902 described herein. Exemplary radial cross-sectional shapes 414*a*,414*b*,514,614,714,814*a*,814*b*,914 for the portion of the reinforcing structure 402,502,602,702,802,902 extending from the metal blank 404,504,604,704,804,904 may include, but are not limited to, a circle (FIG. 10), an oval, a triangle, a square, a rectangle, a rhombus, a hexagon (FIG. 13), an octagon, a cross (FIG. 11), a gear (i.e., a circular pattern with protrusions extending therefrom, as illustrated in FIG. 12 with six protrusions), and the like. In some instances, a reinforcing structure may have more than one radial cross-sectional shape. For example, if reinforcing structure 402 is a hex-head bolt, the reinforcing structure 402 has both a circular radial cross-sectional shape 414*a* and a hexagonal radial cross-sectional shape 414*b*.

The reinforcing structure 402,502,602,702,802,902 may extend from the metal blank 404,504,604,704,804,904 any suitable distance (length). For example, reinforcing structure 402,502,602,702,802,902 may extend between 1 mm and 100 mm, between 1 mm and 5 mm, between 5 mm and 10 cm, between 5 mm and 25 mm, between 10 mm and 25 mm, between 10 mm and 50 mm, or between 25 mm and 100 mm from the metal blank 404,504,604,704,804,904.

The reinforcing structure 402,502,602,702,802,902 may have a diameter (defined as the diameter of the largest radial cross-section) between 1 mm and 50 mm, between 1 mm and 25 mm, between 1 mm and 10 mm, between 5 mm and 25 mm, between 5 mm and 10 mm, between 10 mm and 50 mm, or between 10 mm and 25 mm. The diameter for non-circular radial cross-sections is defined as the diameter of the smallest circle that encompasses the non-circular radial cross-section.

When a reinforcing structure 402,502,602,702,802,902 is distinct from and coupled to a metal blank 404,504,604,704,804,904, the composition of the reinforcing structure 402,502,602,702,802,902 may be chosen to form a strong interfacial bond with the MMC to be formed therearound (e.g., MMC 208 of FIG. 2). For example, the reinforcing structures 402,502,602,702 may comprise or be formed of an MMC, which may be the same, similar, or dissimilar to the MMC 208 that forms the bit body 108. During the infiltration process for forming the bit body 108, the MMC 208 may more readily bond to an MMC reinforcing structure having the same or similar composition to the MMC 208.

Other compositions suitable for a reinforcing structure 402,502,602,702,802,902 may include, but are not limited to, steel, titanium, and the like, and any combination thereof. In some embodiments, the reinforcing structures may be coated or clad with materials that form a stronger interfacial bond with the binder material.

In some instances, the portion of the reinforcing structure 402,602,802,902 extending from the metal blank 404,604,804,904 may be perpendicular to the metal blank 404,604,804,904 at a surface 410,610,810,910 of the metal blank 404,604,804,904. In some embodiments, the portion of the reinforcing structure 502,702 extending from the metal blank 504,704 may be positioned at an angle 512*a*,512*b*,712*a*,712*b* that is less than or greater than 90°. Accordingly, in some embodiments, the reinforcing structures described herein may extend into the surrounding MMC of the bit body at an angle relative to the surface of the metal blank that is less than 90°, 90°, or greater than 90°.

The foregoing concepts of shape, size, and angle of the portion of the reinforcing structure extending from the metal blank may be applied to reinforcing structures 228 illustrated in FIG. 2 that may be machined portions of the reinforcing metal blank 202.

The placement of the reinforcing structures described herein may also be chosen to provide additional mechanical strength to the bond between the MMC of the bit body and the reinforcing metal blank.

FIGS. 14-17 illustrate isometric cross-sectional views of reinforcing metal blanks 1400,1500,1600,1700 with different configurations for the positions (represented by X) of the reinforcing structures.

Figure 14:
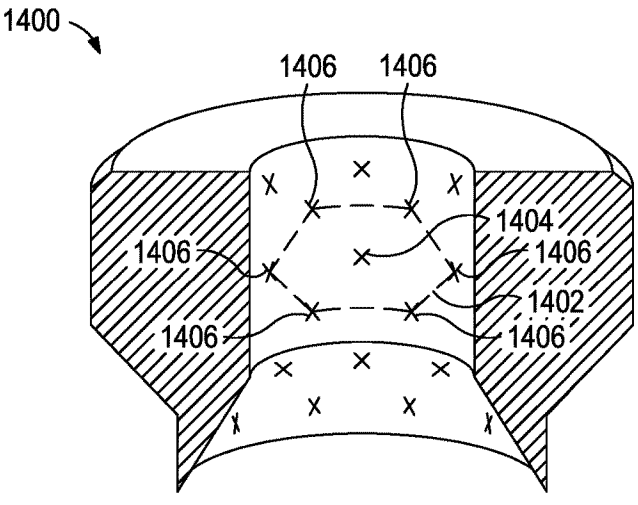

FIG. 14 illustrates an offset pattern where the reinforcing structures are spaced apart in an equidistant-hexagonal packing pattern 1402 such that a central position 1404 is equidistant to the six nearest positions 1406.

Figure 15:
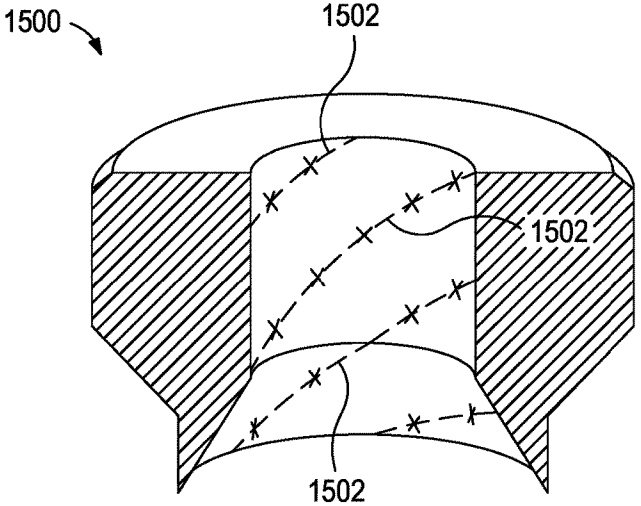
FIGS. 14-17 illustrate isometric cross-sectional views of reinforcing metal blanks with different configurations for positioning the reinforcing structures.

FIG. 15 illustrates a helical pattern where the reinforcing structures are positioned along helices 1502 curving along the surface of the reinforcing metal blank 1500.

Figure 16:
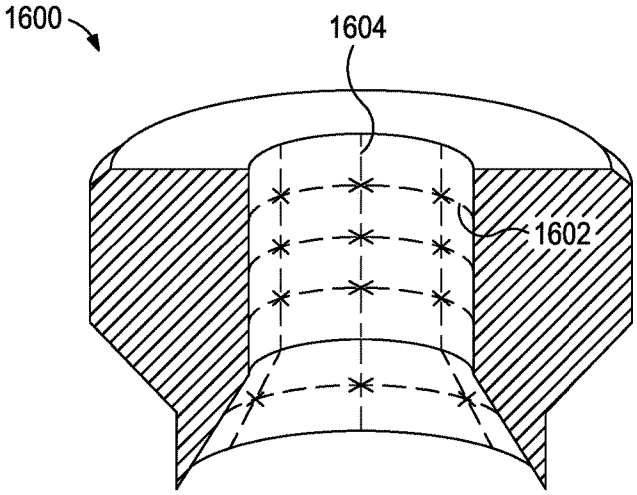

FIG. 16 illustrates a rectangular grid pattern where the reinforcing structures are positioned at the intersections 1602 of perpendicular lines forming a grid 1604 along the surface of the reinforcing metal blank 1600. In some instances, the grid 1604 may form squares.

Figure 17:
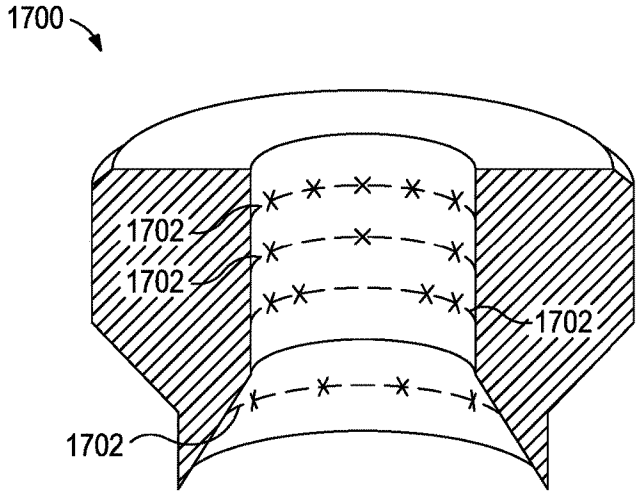

FIG. 17 illustrates an exemplary irregular pattern where the reinforcing structures are positioned along longitudinally off-set circumferences 1702 along the surface. In this pattern, the spacing of the reinforcing structures may be different for each circumference 1702 or at least some of the circumferences 1702.

FIGS. 14-17 provide only exemplary patterns and are, for simplicity, illustrated on only the inner surface of the reinforcing metal blanks 1400,1500,1600,1700. However, these and other patterns may be implemented along at least a portion of the inner surface of the reinforcing metal blank and/or at least a portion of the outer surface of the reinforcing metal blank. Further, in some instances, different portions of each of the inner and outer surfaces may have different patterns of reinforcing structures. In some instances, mathematical modeling may be used to determine and/or optimize the positioning of the reinforcing structures on the inner and/or outer surfaces of the reinforcing metal blanks.

Figure 18:
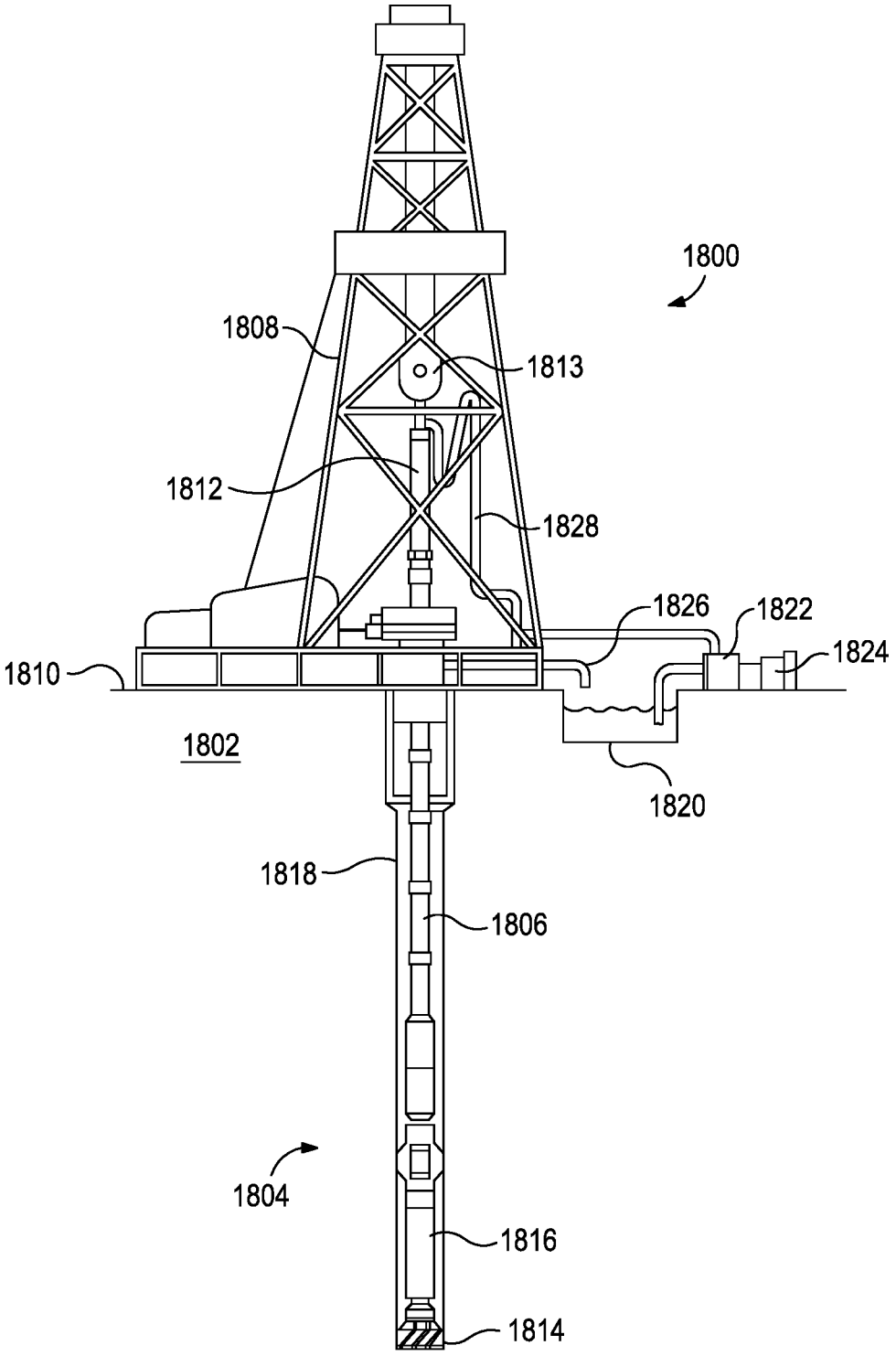
FIG. 18 is a schematic drawing showing a drilling assembly suitable for using a matrix MMC drill bit in accordance with the present disclosure.

FIG. 18, illustrated is an exemplary drilling system 1800 that may employ one or more principles of the present disclosure. Boreholes may be created by drilling into the earth 1802 using the drilling system 1800. The drilling system 1800 may be configured to drive a bottom hole assembly (BHA) 1804 positioned or otherwise arranged at the bottom of a drill string 1806 extended into the earth 1802 from a derrick 1808 arranged at the surface 1810. The derrick 1808 includes a kelly 1812 and a traveling block 1813 used to lower and raise the kelly 1812 and the drill string 1806.

The BHA 1804 may include a MMC drill bit 1814 operatively coupled to a tool string 1816 which may be moved axially within a drilled wellbore 1818 as attached to the drill string 1806. The MMC drill bit 1814 may be fabricated and otherwise created in accordance with the principles of the present disclosure. During operation, the MMC drill bit 1814 penetrates the earth 1802 and thereby creates the wellbore 1818. The BHA 1804 provides directional control of the MMC drill bit 1814 as it advances into the earth 1802. The tool string 1816 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 1816, as shown in FIG. 18.

Fluid or "mud" from a mud tank 1820 may be pumped downhole using a mud pump 1822 powered by an adjacent power source, such as a prime mover or motor 1824. The mud may be pumped from the mud tank 1820, through a stand pipe 1826, which feeds the mud into the drill string 1806 and conveys the same to the MMC drill bit 1814. The mud exits one or more nozzles arranged in the MMC drill bit 1814 and in the process cools the MMC drill bit 1814. After exiting the MMC drill bit 1814, the mud circulates back to the surface 1810 via the annulus defined between the wellbore 1818 and the drill string 1806, and in the process, returns drill cuttings and debris to the surface. The cuttings and mud mixture are passed through a flow line 1828 and are processed such that a cleaned mud is returned down hole through the stand pipe 1826 once again.

Although the drilling system 1800 is shown and described with respect to a rotary drill system in FIG. 18, those skilled in the art will readily appreciate that many types of drilling systems can be employed in carrying out embodiments of the disclosure. For instance, drills and drill rigs used in embodiments of the disclosure may be used onshore (as depicted in FIG. 18) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Embodiments described herein include:

Embodiment A: a MMC drill bit comprising: a shank; a reinforcing metal blank coupled to the shank and extending into a bit body comprising a metal matrix composite, wherein the reinforcing metal blank defines an inner surface and outer surface; a plurality of reinforcing structures positioned on one or both of the inner and outer surfaces and extending into the metal matrix composite; and a plurality of cutting elements coupled to an exterior portion of the bit body;

Embodiment B: a drilling assembly comprising: a drill string extendable from a drilling platform and into a wellbore; a MMC drill bit according to Embodiment A attached to an end of the drill string; and a pump fluidly connected to the drill string and configured to circulate a drilling fluid to the MMC drill bit and through the wellbore; and Embodiment C: a method comprising: coupling reinforcing structures to at least one of an inner surface and an outer surface of a metal blank along, thereby forming a reinforcing metal blank; and forming a metal matrix composite drill bit comprising the reinforcing metal blank and a metal matrix composite such that the reinforcing structures extend into the metal matrix composite Embodiments A and B may optionally further include one or more of the following elements: Element 1: wherein some or all of the plurality of reinforcing structures are machined portions of the reinforcing metal blank; Element 2: wherein some or all of the plurality of reinforcing structures are coupled to a metal blank to form the reinforcing metal blank; Element 3: Element 2 and wherein the metal matrix composite is a first metal matrix composite, and wherein at least one of the reinforcing structures comprises a second metal matrix composite; Element 4: Element 2 and wherein some or all of the plurality of reinforcing structures are coupled to the metal blank by a braze joint, a weld joint, a threaded joint, or an interference joint; Element 5: Element 2 and wherein some or all of the plurality of reinforcing structures comprise bolts threadably coupled to the metal blank; Element 6: wherein some or all of the plurality of reinforcing structures extend between 1 mm and 100 mm into the metal matrix composite; Element 7: wherein at least a portion of some or all of the plurality of reinforcing structures extending into the metal matrix composite have a radial cross-sectional shape of: a circle, a cross, a gear, an oval, a triangle, a square, a rectangle, a rhombus, a hexagon, or an octagon; Element 8: wherein some or all of the plurality of reinforcing structures extend into the metal matrix composite at an angle that is the less than 90° relative to the inner surface or outer surface; and Element 9: wherein some or all of the plurality of reinforcing structures extend into the metal matrix composite at an angle that is the greater than 90° relative to the inner surface or outer surface. Exemplary combinations of the foregoing elements may include, but are not limited to, Element 1 and Element 2 in combination and optionally in further combination with one or more of Elements 3-5; one or more of Elements 6-9 in combination with Element 1 and/or Element 2 and optionally in further combination with one or more of Elements 3-5; two or more of Elements 6-9 in combination; and Element 2 in combination with two or more of Elements 3-5.

Embodiment C may optionally further include one or more of the following elements: Element 10: wherein some or all of the reinforcing structures are a bolt, and wherein coupling the reinforcing structures to the metal blank comprises threadably coupling the bolt to the metal blank; Element 11: wherein coupling the reinforcing structures to the metal blank comprises brazing at least one of the reinforcing structures to the metal blank; Element 12: wherein the metal matrix composite is a first metal matrix composite, and wherein at least one of the reinforcing structures comprises a second metal matrix composite; Element 13: wherein coupling involves forming an interference joint with the metal blank; Element 14: wherein some or all of the reinforcing structures extend between 1 mm and 100 mm into the metal matrix composite; Element 15: wherein at least a portion of some or all of the reinforcing structures extending into the metal matrix composite have a radial cross-sectional shape of: a circle, a cross, a gear, an oval, a triangle, a square, a rectangle, a rhombus, a hexagon, or an octagon; Element 16: wherein some or all of the reinforcing structures extend into the metal matrix composite at an angle that is the less than 90° relative to the inner surface or outer surface; and Element 17: wherein some or all of the reinforcing structures extend into the metal matrix composite at an angle that is the greater than 90° relative to the inner surface or outer surface. Exemplary combinations of the foregoing elements may include, but are not limited to, two or more of Elements 10, 11, or 13 in combination; Element 12 in combination with one or more of Elements 10, 11, or 13; two or more of Elements 14-17 in combination; and one or more of Elements 14-17 in combination one or more of Elements 10-13.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Further-more, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of or" consist of the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A metal matrix composite (MMC) drill bit comprising:
- a shank;
- a reinforcing metal blank coupled to the shank and extending into a bit body comprising a metal matrix composite, wherein the reinforcing metal blank defines an inner surface and outer surface;
- a plurality of reinforcing structures positioned on one or both of the inner and outer surfaces and extending into the metal matrix composite, wherein some or all of the plurality of reinforcing structures are coupled to a metal blank to form the reinforcing metal blank; and
- a plurality of cutting elements coupled to an exterior portion of the bit body.

2. The MMC drill bit of claim 1, wherein some or all of the plurality of reinforcing structures are machined portions of the reinforcing metal blank.

3. The MMC drill bit of claim 1, wherein the metal matrix composite is a first metal matrix composite, and wherein at least one of the reinforcing structures comprises a second metal matrix composite.

4. The MMC drill bit of claim 1, wherein some or all of the plurality of reinforcing structures are coupled to the metal blank by a braze joint, a weld joint, a threaded joint, or an interference joint.

5. The MMC drill bit of claim 1, wherein some or all of the plurality of reinforcing structures comprise bolts threadably coupled to the metal blank.

6. The MMC drill bit of claim 1, wherein some or all of the plurality of reinforcing structures extend between 1 mm and 100 mm into the metal matrix composite.

7. The MMC drill bit of claim 1, wherein at least a portion of some or all of the plurality of reinforcing structures extending into the metal matrix composite have a radial cross-sectional shape of: a circle, a cross, a gear, an oval, a triangle, a square, a rectangle, a rhombus, a hexagon, or an octagon.

8. The MMC drill bit of claim 1, wherein some or all of the plurality of reinforcing structures extend into the metal matrix composite at an angle that is the less than 90° relative to the inner surface or outer surface.

9. The MMC drill bit of claim 1, wherein some or all of the plurality of reinforcing structures extend into the metal matrix composite at an angle that is the greater than 90° relative to the inner surface or outer surface.

10. A method comprising:
- coupling reinforcing structures to at least one of an inner surface and an outer surface of a metal blank along, thereby forming a reinforcing metal blank, wherein some or all of the reinforcing structures are a bolt, and wherein coupling the reinforcing structures to the metal blank comprises threadably coupling the bolt to the metal blank; and
- forming a metal matrix composite drill bit comprising the reinforcing metal blank and a metal matrix composite such that the reinforcing structures extend into the metal matrix composite.

11. A method comprising:
- coupling reinforcing structures to at least one of an inner surface and an outer surface of a metal blank along, thereby forming a reinforcing metal blank, wherein coupling the reinforcing structures to the metal blank comprises brazing at least one of the reinforcing structures to the metal blank; and
- forming a metal matrix composite drill bit comprising the reinforcing metal blank and a metal matrix composite such that the reinforcing structures extend into the metal matrix composite.

12. A drilling assembly comprising:
- a drill string extendable from a drilling platform and into a wellbore;
- a metal matrix composite (MMC) drill bit attached to an end of the drill string, wherein the MMC drill bit comprises:
  - a shank;
  - a reinforcing metal blank coupled to the shank and extending into a bit body comprising a metal matrix composite, wherein the reinforcing metal blank defines an inner surface and outer surface;
  - a plurality of reinforcing structures positioned on one or both of the inner and outer surfaces and extending into the metal matrix composite, wherein some or all of the plurality of reinforcing structures are coupled to a metal blank to form the reinforcing metal blank; and
  - a plurality of cutting elements coupled to an exterior portion of the bit body; and
- a pump fluidly connected to the drill string and configured to circulate a drilling fluid to the MMC drill bit and through the wellbore.

13. The drilling assembly of claim 12, wherein some or all of the plurality of reinforcing structures are machined portions of the reinforcing metal blank.

14. The drilling assembly of claim 12, wherein the metal matrix composite is a first metal matrix composite, and wherein at least one of the reinforcing structures comprises a second metal matrix composite.

15. The drilling assembly of claim 12, wherein some or all of the plurality of reinforcing structures comprise bolts threadably coupled to the metal blank.

16. The drilling assembly of claim 12, wherein some or all of the plurality of reinforcing structures extend into the metal matrix composite at an angle that is the less than 90° relative to the inner surface or outer surface.

17. The drilling assembly of claim 12, wherein some or all of the plurality of reinforcing structures extend into the metal matrix composite at an angle that is the greater than 90° relative to the inner surface or outer surface.

* * * * *